US005914998A

United States Patent [19]

Izumi

[11] Patent Number: 5,914,998

[45] Date of Patent: Jun. 22, 1999

[54] X-RAY MICROBEAM GENERATING METHOD AND DEVICE FOR THE SAME

[75] Inventor: Koichi Izumi, Tokyo, Japan

[73] Assignee: NEC Corporation, Tokyo, Japan

[21] Appl. No.: 08/936,384

[22] Filed: Sep. 25, 1997

[30] Foreign Application Priority Data

| | | | |
|---|---|---|---|
| Sep. 27, 1996 | [JP] | Japan | 8-256011 |
| Jan. 10, 1997 | [JP] | Japan | 9-002942 |
| Feb. 5, 1997 | [JP] | Japan | 9-022506 |

[51] Int. Cl.[6] ..... G21K 7/60

[52] U.S. Cl. ..... 378/84; 378/43

[58] Field of Search ..... 378/84, 85, 82, 378/43, 36, 145

[56] References Cited

U.S. PATENT DOCUMENTS

| | | | |
|---|---|---|---|
| 5,199,057 | 3/1993 | Tamura et al. | 378/84 X |
| 5,259,013 | 11/1993 | Kurigama et al. | 378/43 |
| 5,274,435 | 12/1993 | Hettrick | 378/84 X |

FOREIGN PATENT DOCUMENTS

| | | |
|---|---|---|
| 635 716 A1 | 1/1995 | European Pat. Off. . |
| 3217235 A1 | 11/1983 | Germany . |
| WO 88/01428 | 2/1988 | WIPO . |

OTHER PUBLICATIONS

Rev. Sci. Instrum., vol. 66, No. 2, Feb. 1995, pp. 1506–1509, Braver et al.

EPO–Patent abstract of Japan No. 02150034, Feb. 13, 1992, Katsuhisa.

*Primary Examiner*—David P. Porta
*Attorney, Agent, or Firm*—Laff, Whitesel, Conte & Saret, Ltd.

[57] ABSTRACT

A method of generating an X-ray microbeam of the present invention generates an X-ray microbeam having a restricted divergence angle and desirable planeness in regions other than the focus. With this method, it is possible to compensate for a change in the degree of asymmetry ascriable to a change in the wavelength of X-rays selected, and therefore to maintain the degree of asymmetry constant. In addition, the condensing conditions including the energy of X-rays and beam size each can be set independently of the others. A device for practicing the above method is also disclosed.

2 Claims, 4 Drawing Sheets

X-RAY MICROBEAM GENERATING METHOD AND DEVICE FOR THE SAME

BACKGROUND OF THE INVENTION

The present invention relates to an X-ray microbeam generating method for various kinds of apparatuses using X-rays, and a device for practicing the same.

Apparatuses using X-rays are extensively used today. X-rays for such an application must be condensed to form a microbeam having a small beam size. Various kinds of technologies for condensing X-rays have been proposed in the past. For example, X-rays, issuing from an X-ray generator or X-ray source may be condensed to a focus position or virtual light source by an X-ray Fresnel zone plate playing the role of a condensing element. The Fresnel zone plate may be replaced with a mirror totally reflecting X-rays on the basis of the fact that X-rays having a refractive index smaller than 1 are totally reflected when incident to the surface of an object at an angle less than a critical angle. Japanese Patent Laid-Open Publication Nos. 62-15014 and 4-43998 each teaches an arrangement including an asymmetrical reflection type crystal collimator located on an input X-ray path and a mirror. X-rays from a false emission point defined by the crystal collimator and X-rays from the original emission point are reflected to the same point by asymmetrical X-ray diffraction. Further, an X-ray beam may have its cross-section restricted by a slit or a pin hole so as to produce a spatially restricted X-ray beam.

On the other hand, a solar slit or dynamic diffraction using the perfect crystal of X-rays has customarily been used to restrict the angular divergence of an X-ray beam. However, the solar slit scheme can restrict the divergence angle to the order of minutes at most, so that the resulting microbeam is too broad to be called a plane wave. As for the X-ray perfect crystal scheme, X-rays scarcely interacts with a substance, so that a great number of lattice planes join in diffraction. That is, a great number of reflected waves contribute to interference, implementing a noticeable interference effect. This further restricts the angular spread of the diffracted wave and allows, under diffraction conditions, angular divergence in the direction of scattering planes defined by the direction of input X-rays and the direction of diffracted X-rays to the order to seconds.

However, the condensation of X-rays and the restriction of the divergence angle of X-rays have customarily been effected independently of each other, failing to produce an X-ray microbeam having a restricted divergence angle. This is because condensation is not achievable without increasing the angular divergence and because the angular divergence cannot be reduced without increasing the spatial spread. Moreover, the spatial spread can be reduced by a condensing element only at the focal position; at the other positions, the beam size increases. Therefore, as the distance from the focal position increases, the microbeam spatially spreads by many figures due to angular divergence. That is, the microbeam cannot be used at positions other than the focal position.

SUMMARY OF THE INVENTION

It is therefore an object of the present invention to provide a method capable of generating an X-ray microbeam with a restricted divergence angle and desirable condensed planeness, and a device for practicing the same.

It is another object of the present invention to provide a method capable of generating and X-ray microbeam while maintaining a constant degree of asymmetry and a constant condensing efficiency even when the wavelength of X-rays is changed.

In accordance with the present invention, a method of generating a plane wave X-ray microbeam has the steps of condensing X-rays issuing from an X-ray source to a focus, causing diffractions having scattering planes perpendicular to each other to occur simultaneously, and restricting the divergence angle of the condensed X-ray beam to thereby separate a part of the X-ray beam which can be considered to be a plane wave.

Also, in accordance with the present invention, a device for generating a plane wave X-ray microbeam has an X-ray source, a condensing element for condensing X-rays issuing from the X-ray source to a focus, and an optical element located at a focus for restricting the divergence angle of a condensed X-ray beam.

Further, in accordance with the present invention, in a method of generating an X-ray microbeam by using an asymmetrical reflection X-ray diffraction method using a diffraction plane not parallel to a crystal surface, a crystal is rotated about an axis perpendicular to the diffraction plane so as to vary an input angle to and an output angle from the crystal surface while preserving a Bragg condition.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
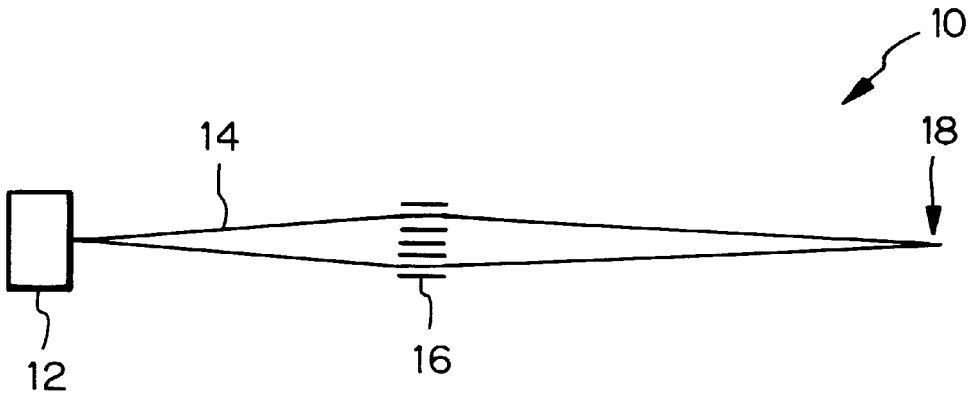
Fig. 1 PRIOR ART
FIG. 1 is a schematic view showing a conventional device for condensing an X-ray beam by using an X-ray Fresnel zone plane.

To better understand the present invention, brief reference will be made to a conventional device for condensing X-ray beam, shown in FIG. 1. As shown, the device, generally 10, includes an X-ray generator or X-ray source for emitting X-rays 14. The X-rays 14 issuing from the X-ray generator 12 are condensed by an X-ray Fresnel zone plate 16 to a focus or virtual light source 18. The X-ray Fresnel zone plate 16 is a Fresnel zone plate originally established for visible rays and applied to X-rays.

Figure 2:
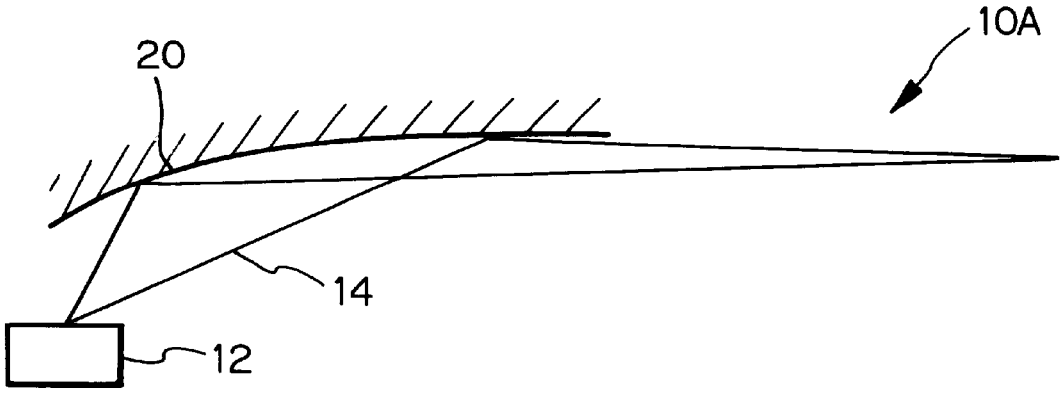
Fig. 2 PRIOR ART
FIG. 2 is a schematic view showing a conventional device for condensing an X-ray beam by using a total reflection mirror.

FIG. 2 shows another conventional X-ray beam condensing device. As shown, the device, generally 10A, includes a mirror 20 for totally reflecting X-rays in place of the Fresnel zone plate 16. This device is based on the fact that because the X-rays 14 have a refractive index smaller than 1, they are totally reflected when incident to the surface of the mirror 20 at an angle less than a critical angle.

Figure 3:
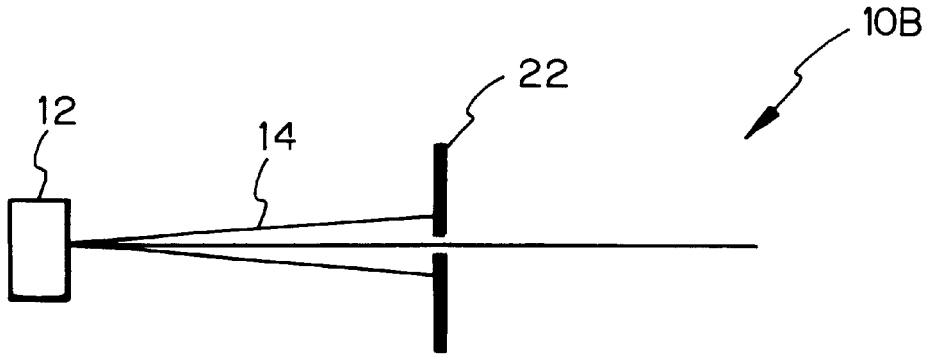
Fig. 3 PRIOR ART
FIG. 3 is a schematic view showing a conventional device for condensing an X-ray beam by using a slit or a pin hole.

FIG. 3 shows still another conventional X-ray beam condensing device. As shown, the device, generally 10B, spatially reduces the sectional area of the X-ray beam 14 by using a pin hole or a slit 22.

The conventional device shown in FIGS. 1–3 have some problems left unsolved, as discussed earlier.

Basically, in accordance with the present invention, X-rays are condensed to form a microbeam. Then, a part of the microbeam which can be considered to be a plane wave is separated. Specifically, a plane wave X-ray microbeam generating device in accordance with the present invention includes an X-ray generator or X-ray source and a condensing element. A simultaneous reflection Borrmann element is located at the focus of the condensing element. X-rays issuing from the X-ray generator have their divergence angle restricted by the Borrmann element. The X-ray generator may be implemented by synchrotron radiation or an X-ray tube. In a diffraction condition wherein divergence planes defined by the direction of incident X-rays and that of diffracted X-rays are perpendicular to each other, angular divergence in the direction contained in the divergence planes can be restricted to the order of seconds. When the divergence angle is restricted by such dynamical diffraction, not only a wave diffracted in the direction of reflection but also a wave diffracted in the direction of transmission can be restricted in divergence angle.

Figure 4:
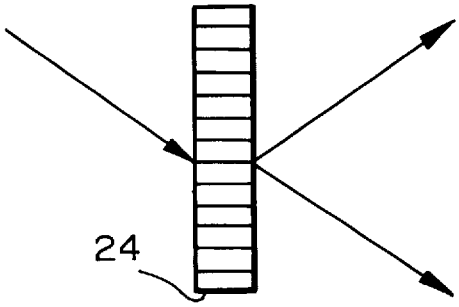
FIG. 4 is a schematic view for describing a Laue-case diffraction.

FIG. 4 shows Laue-case diffraction. As shown, assume that a single crystal of silicon 24 has a sufficient thickness. Then, Laue-case diffraction increases the X-ray beam transmittance in the transmission direction, compared to a case without diffraction, and further restricts the angular divergence. Such an anomalous transmission phenomenon is referred to as the Borrmann effect. When a plurality of lattice planes joining in diffraction are present, there appear a wave in the transmission direction and the same number of waves as the lattice planes in the reflection direction (simultaneous reflection or multiple-beam diffraction). The simultaneous reflection refers to a condition wherein when diffraction satisfying the Bragg condition occurs for a certain lattice plane (h, k, l), it also satisfies the Bragg condition for another lattice plane (m, n, o) at the same time.

Figure 5A:
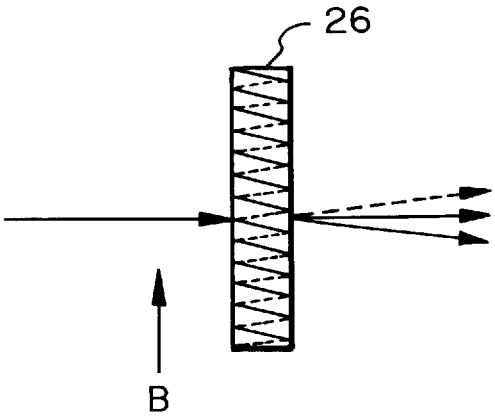
FIGS. 5A and 5B demonstrate simultaneous reflection or multiple-beam diffraction in which a plurality of lattice planes join.
Figure 5B:
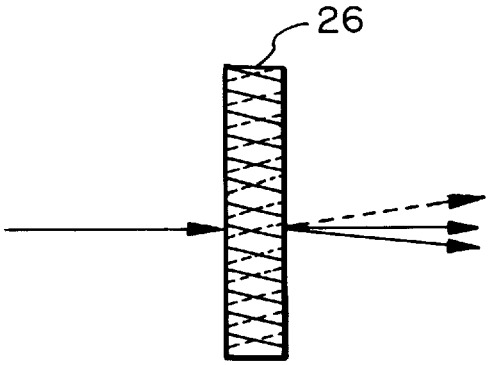

FIGS. 5A and 5B demonstrate simultaneous reflection to which a plurality of lattice planes are related. FIGS. 5A and 5B are sections perpendicular to each other; FIG. 5B is a section as seen in the direction of an arrow B shown in FIG. 5A. While lattice planes and the direction of diffracted X-rays indicated by broken lines are representative of diffraction incidentally allowable due to the symmetry of a single crystal of silicon 26, they are not relevant to the present invention. Because the two diffraction planes are perpendicular to each other, the X-ray beam in the transmission direction has its divergence angle restricted in the direction contained in the individual scattering plane by diffraction. As a result, an X-ray beam restricted in the two different directions is achievable. A slit is positioned after the Borrmann diffraction element. A part of the X-rays transmitted and diffracted by an optical element, i.e., satisfied the diffraction conditions is selectively produced at the outlet side of the above slit. This successfully generates a plane wave X-ray microbeam.

The prerequisite with the above arrangement is that the X-ray generator, condensing element, simultaneous reflection Borrmann element and slit be sequentially arranged in this order. Should the condensing element be positioned after the Borrmann element, the divergence angle would increase and would prevent an X-ray beam having a small beam size and a small divergence angle from being achieved.

Figure 6:
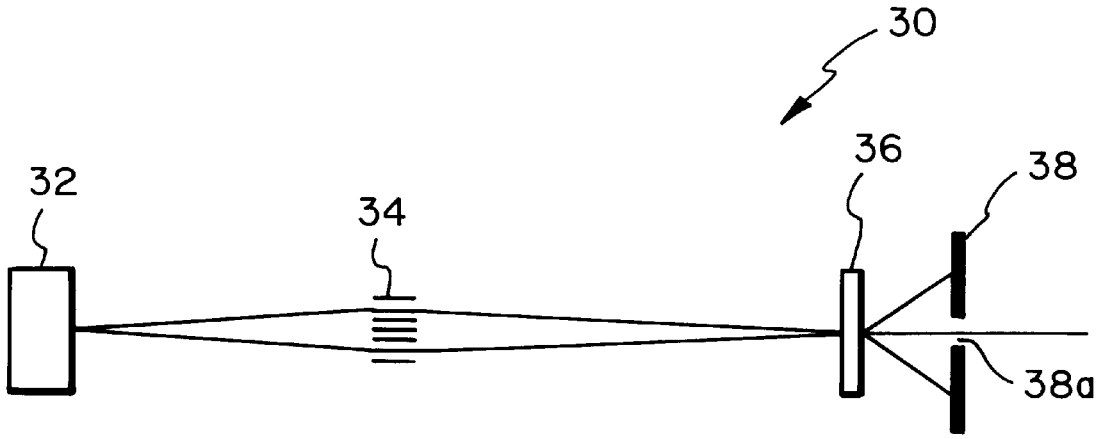
FIG. 6 is a schematic view showing an X-ray microbeam generating device embodying the present invention.

Referring to FIG. 6, an X-ray microbeam generating device embodying the present invention will be described. As shown, the microbeam generating device, generally 30, includes an X-ray generator 32 capable of emitting X-rays having a size of 3 mm square, a divergence angle of 4 mrad, and a number of photons of $10^{-9}$/sec. A condensing element is implemented by a Fresnel zone plate 34. A simultaneous reflection Borrmann element 46 has a single crystal of silicon which is 2 mm thick (1.4 mm or above) and has a (001) plane. A 1 mm to 5 mm tantalum plate 38 is spaced from the diffraction element 36 by about 5 cm and formed with an aperture having a diameter of 5 mm. If desired, the Fresnel zone plate 34 may be replaced with a mirror totally reflecting X-rays or a Bragg Fresnel lens which is a reflection type Fresnel lens.

In the above device 30, X-rays issuing from the X-ray generator 32 is spatially restricted by the Fresnel zone plate 34 to turn out an X-ray beam. The X-ray beam has its divergence angle restricted by the Borrmann element 36 located at the focus of the Fresnel zone plate 34 (focal distance of 1 m). As a result, a plane wave X-ray microbeam is generated. Subsequently, the diffraction element 36 causes $33\bar{3}$, $\bar{3}3\bar{3}$, $\bar{3}\bar{3}\bar{3}$ and $3\bar{3}\bar{3}$ reflections to occur at the same time for the X-ray with the wavelength of 0.12 nm. Waves diffracted by 70 degrees with respect to the incidence direction are excluded by a slit 38*a* formed in the tantalum plate 38, so that only a wave diffracted in the transmission direction is separated. Experiments showed that the transmitted wave had a divergence angle of 1 second to 2 seconds and a beam diameter of up to about 10 $\mu$m.

The illustrative embodiment is not limited to the above parameters, but allows any suitable lattice planes matching with a wavelength to be selected. For example, when X-rays having a wavelength of 0.36 nm may be incident perpendicularly to a silicon (001) plane in order to cause $11\bar{1}$, $\bar{1}1\bar{1}$, $\bar{1}\bar{1}\bar{1}$ and $1\bar{1}\bar{1}$ reflections to occur at the same time. Likewise, for 0.0–72 nm or 0.052 nm X-rays, use may be made of $55\bar{5}$, $\bar{5}5\bar{5}$, $\bar{5}\bar{5}\bar{5}$ and $5\bar{5}\bar{5}$ reflections or $77\bar{7}$, $\bar{7}7\bar{7}$, $\bar{7}\bar{7}\bar{7}$ and $7\bar{7}\bar{7}$ reflections. Further, silicon playing the role of a diffracting element may be replaced with, e.g., germanium or crystal so as to change the distance between lattice planes. Such an alternative crystal is adaptive to another wavelength.

Assume that the slit 38*a* of the tantalum plate 38 is replaced with a pin hole. Then, the pin hole is located at a position where the X-rays are incident to the diffraction element, because the size of the X-ray beam is minimum at the pin hole. For this purpose, metal or the like is deposited on the incidence surface of the silicone crystal of the diffraction element 36, FIG. 6, and a pin hole (up to 1 $\mu$m) is formed at the incidence point by a laser. With this configuration, it is also possible to generate a plane wave X-ray microbeam. So long as the silicon crystal has a sufficient thickness, the planeness of the wave is not effected due to the Borrmann effect although the intensity of the output beam is reduced.

As stated above, the illustrative embodiment is capable of generating an X-ray microbeam having a restricted divergence angle and desirable planeness in regions other than the focus. This realizes the use of a plane wave X-ray microbeam having a sufficiently small spatial spread. Consequently, limitations heretofore posed on the work region due to the focus and on the work distance are obviated, so that the fine structure of a substance can be easily analyzed by, e.g., X-ray analysis.

Figure 7:
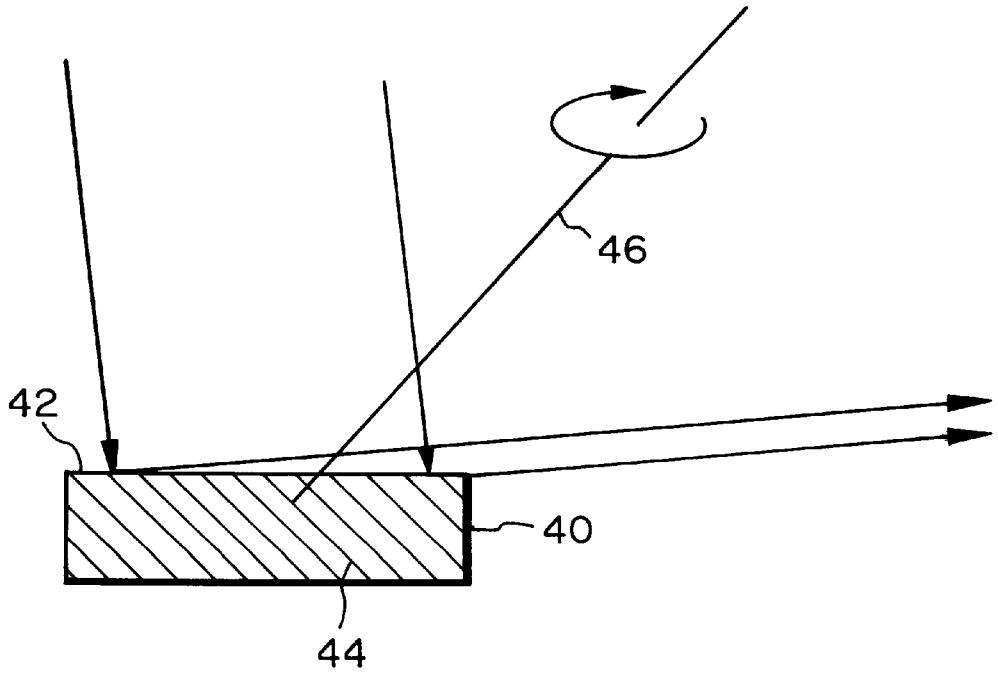
FIG. 7 is a schematic view showing an alternative embodiment of the present invention.

Reference will be made to FIG. 7 for describing an alternative embodiment of the present invention. As shown, in this embodiment, the size of the X-ray beam is reduced by asymmetrical reflection using a reflection plane not parallel to a crystal surface 42, i.e., a lattice plane 44. A crystal 40 is rotated about an axis 46 perpendicular to the lattice plane 44 in order to vary the incident angle and exit angle from the crystal surface 42. This allows the asymmetric factor, i.e., the degree of asymmetry ascriable to a change in the energy of X-rays to remain constant and thereby implements X-ray energy scanning without effecting the condensing efficiency. Assuming that the asymmetry factor is b, then b is expressed in terms of an angle $\theta_o$ between the crystal surface 42 and the input X-rays and an angle $\theta_G$ between the surface 42 and the output X-rays, as follows:

$$b=\sin\theta_o/\sin\theta_G \quad \text{Eq.(1)}$$

By diffraction with the above degree of asymmetry, the spatial spread of the input X-rays in the scattering plane is increased by 1/b times in terms of output X-rays, while the angular divergence is increased by b times. Assuming a Bragg angle $\theta_B$ and an angle $\alpha$ between the lattice plane 44 relating to the diffraction and the crystal surface 42, then the degree of asymmetry b is produced by:

$$b=\sin(\theta_B+\alpha)/\sin(\theta_B-\alpha) \quad \text{Eq.(2)}$$

where $\alpha$ may range from $-\theta_B$ to $\theta_B$.

If a plurality of crystals are used to effect sequential reflection, then the beam size can be further reduced. In the asymmetric reflection, by rotating the crystal 40 about the axis 46 perpendicular to the lattice plane 44, it is possible to vary the angles of the input X-rays and output X-rays to the crystal surface. Consequently, in the range of rotation of from 0 degree to 180 degrees, the asymmetry factor can be varied from b up to 1/b, including b=1 holding when the angle of rotation is 90 degrees ($\alpha$=0). The rotation of the crystal 40 therefore compensates for a change in the wavelength (or energy) of the input X-rays and therefor a change in the degree of asymmetry, i.e., Bragg angle, thereby maintaining the degree of asymmetry constant. Further, any desired condensing conditions or values are selectable on the basis of the degree of asymmetry b, so that the beam size can be varied.

Figure 8A:
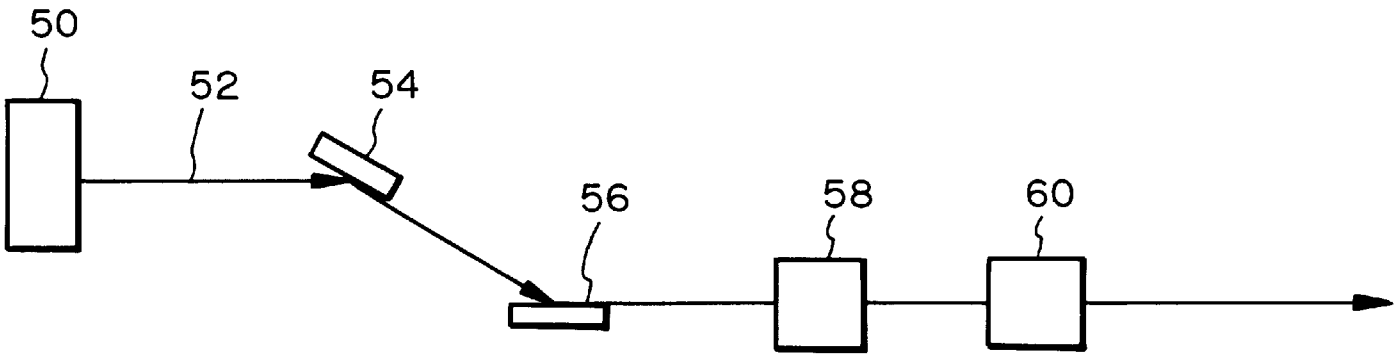
FIGS. 8A and 8B are schematic views showing another alternative embodiment of the present invention.
Figure 8B:
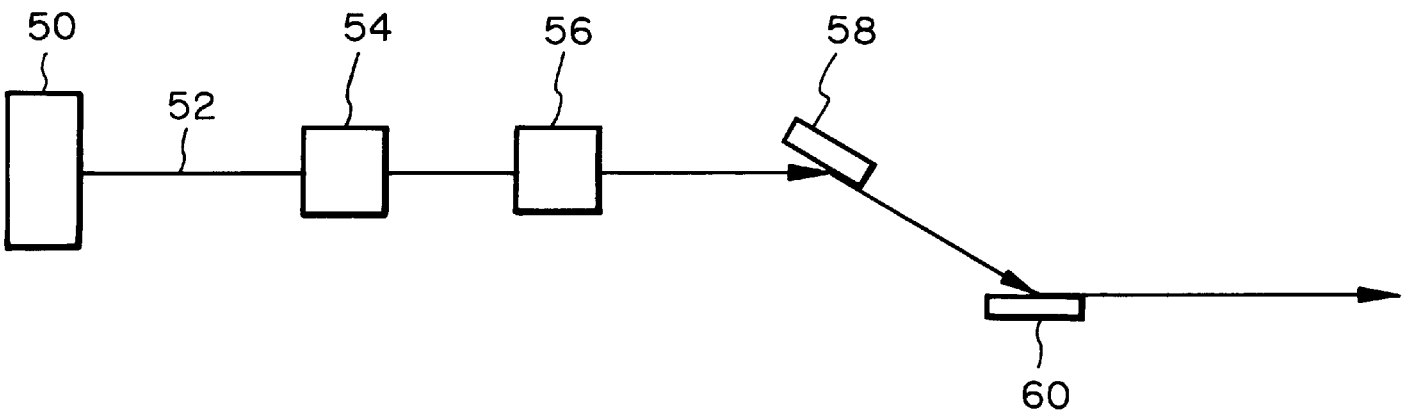

FIGS. 8A and 8B show another alternative embodiment of the present invention. Briefly, this embodiment sequentially uses perpendicular scattering planes for reflection in order to reduce the beam size. In addition, the embodiment reduces the angular width relating to the diffraction of incident X-rays to the order of seconds, thereby generating an X-ray beam having a restricted angular width. As shown in FIGS. 8A and 8B, an X-ray beam 52 issuing from an X-ray generator 50 has its beam size restricted by a single crystal of silicon 54 effecting asymmetrical Bragg reflection. The X-ray generator 50 is implemented by a rotary anode type X-ray generator; the beam size is 1 mm×1 mm. For 0.05 nm X-rays, the Bragg angle for 422 reflection is 13.0 degrees. When the crystal 54 is cut such that the angel between the (422) plane and the crystal surface is 12.0 degrees, the degree of asymmetry b is 24.3

The X-rays diffracted by the crystal 54 are further diffracted by a similar crystal 56, so that the beam size can be further reduced to about 10 $\mu$m, as determined by experiments. Crystals 58 and 60 are arranged to define a scattering plane perpendicular to the scattering plane of the crystals 54 and 56. As a result, the beam size is reduced to about 10 $\mu$m in both the horizontal direction and the vertical direction, as also determined by experiments. The angular divergence of the diffracted X-rays was found to be about 10 seconds. Then, the crystals 54–60 are so rotated as to output X-rays whose wavelength is 0.15 nm. In this case, the Bragg angle and the asymmetry factor are 42.6 degrees and 57.0, respectively. Experiments showed that under the above conditions the condensing conditions noticeable changed and implemented a beam size of about 5 $\mu$m.

It was found by experiments that when the axis 46 of the individual crystal was rotated to implement an angle of 2.3 degrees between the output X-rays and the crystal surface and a degree of asymmetry of about 2.4, the beam size remained to be about 10 $\mu$m despite a change in wavelength. Further, by varying the angle between the output X-rays and the crystal surface, it was possible to vary the beam size steplessly from 10 $\mu$m to several centimeters.

As stated above, in the embodiments shown in FIGS. 7, 8A and 8B, the energy of an X-ray beam having a small diameter can be scanned over a broad range without effecting condensing conditions. This allows EXAFS (Extended X-ray Absorption Fine Structure) or similar experiment to be easily executed with a small beam size. Moreover, the beam size is freely variable via the condensing conditions in order to execute the local strain analysis of a sample or the analysis of a fine structure. Specifically, it is possible to compensate for a change in the degree of asymmetry ascriable to a change in the wavelength of X-rays selected, and therefore to maintain the degree of asymmetry constant. In addition, the condensing conditions including the energy of X-rays and beam size each can be set independently of the others.

Various modifications will become possible for those skilled in the art after receiving the teachings of the present disclosure without departing from the scope thereof.

What is claimed is:

1. A method of generating a plane wave X-ray microbeam, comprising the steps of:

condensing X-rays issuing from an X-ray source to a focus;

causing diffractions having scattering planes perpendicular to each other to occur simultaneously; and restricting a divergence angle of a condensed X-ray beam to thereby separate a part of said X-ray beam to be a plane wave.

2. A method as claimed in claim 1, further comprising locating a slit at an outlet side of said optical element for selectively separating the X-rays transmitted through said optical element.

* * * * *